US006968892B1

(12) United States Patent
Symonds

(10) Patent No.: US 6,968,892 B1
(45) Date of Patent: Nov. 29, 2005

(54) HEAT EXCHANGER

(75) Inventor: Keith Thomas Symonds, Staffs (GB)

(73) Assignee: Chart Heat Exchangers Limited, Cardiff (GB)

( * ) Notice: Subject to any disclaimer, the term of this patent is extended or adjusted under 35 U.S.C. 154(b) by 0 days.

(21) Appl. No.: 09/719,416

(22) PCT Filed: May 21, 1999

(86) PCT No.: PCT/GB99/01622

§ 371 (c)(1),
(2), (4) Date: Dec. 12, 2000

(87) PCT Pub. No.: WO99/66280

PCT Pub. Date: Dec. 23, 1999

(30) Foreign Application Priority Data

Jun. 12, 1998 (GB) ..... 9812560
Feb. 20, 1999 (GB) ..... 9903868

(51) Int. Cl.[7] ..... F28F 3/02
(52) U.S. Cl. ..... 165/165; 165/166; 165/167
(58) Field of Search ..... 165/164–167, 165/DIG. 360

(56) References Cited

U.S. PATENT DOCUMENTS 1,734,274 A * 11/1929 Schubart ..... 165/166
2,537,276 A * 1/1951 McMahon et al. ..... 165/166 X
2,656,159 A * 10/1953 Holm et al. ..... 165/166
3,804,162 A * 4/1974 Kugler et al. ..... 165/DIG. 360
4,612,982 A * 9/1986 Grehier et al. ..... 165/166
4,624,305 A * 11/1986 Rojey ..... 165/165
4,762,172 A * 8/1988 Grehier et al. ..... 165/165
4,934,453 A * 6/1990 Ganz et al. ..... 165/165
4,993,487 A * 2/1991 Niggemann ..... 165/164
5,016,707 A 5/1991 Nguyen ..... 165/167
5,193,611 A 3/1993 Hesselgreaves ..... 165/165

FOREIGN PATENT DOCUMENTS

| | | |
|---|---|---|
| EP | 0 111 459 | 6/1984 |
| EP | 0 780 654 | 6/1997 |
| EP | 0 913 651 | 5/1999 |
| GB | 1 172 247 | 11/1969 |
| WO | 98/55812 | 12/1998 |
| WO | 99/2477 | 5/1999 |

* cited by examiner

*Primary Examiner*—Leonard R. Leo
(74) *Attorney, Agent, or Firm*—Pillsbury Winthrop Shaw Pittman LLP

(57) ABSTRACT

The invention provides an improved heat exchanger of the so-called "pin-fin" type. The heat exchanger comprises a stack of parallel perforated plates, each plate of the stack having perforations, characterized in that the perforations define an array of spaced column precursors, of thickness equal to the plate thickness, the column precursors being joined together by ligaments, each ligament extending between a pair of adjacent column precursors, the ligaments having a thickness less than the plate thickness, the column precursors of any one plate being coincident in the stack with the column precursors of any adjacent plate whereby the stack is provided with an array of individual columns, each column extending perpendicularly to the plane of the plates, whereby fluid flowing through the stack is forced to follow a tortuous flow path to flow around the columns.

22 Claims, 9 Drawing Sheets

HEAT EXCHANGER

This application is the national phase of international application PCT/GB99/01622 filed May 21, 1999.

This invention relates to heat exchangers and is particularly concerned with heat exchangers of the so-called "pin-fin" type.

"Pin-fin" type heat exchangers have been well known in principle for many years and consist essentially of a stack of thin metal plates, adjacent pairs of plates in the stack being separated by a plurality of spaced columns—or pins, which act as the heat exchanger fins, i.e. they create the desired secondary surfaaces. Fluid flowing through the stack passes between adjacent pairs of plates and is forced to follow a tortuous path to flow around the pins in its travel from one side of the stack to the other. Such flow, and the turbulence caused by the pins, leads, theoretically, to good heat transfer properties for the stack.

The pins are essentially columns of solid metal which have to be bonded at their ends to a pair of plates so that the pins are sandwiched between and perpendicular to the plates. The plates form the primary surfaces of the heat exchanger and separate different flow streams and the pins, as indicated above, provide secondary surface areas.

Preferably, the pins need to be bonded, e.g. by brazing, welding, diffusion bonding or any other possible means, in a manner to minimise surface contact resistance.

In practice, however, it has proved difficult to make a satisfactory pin fin stack. It has proved difficult to maintain the pins at their correct spacing relative to each other while creating the necessary conditions, e.g. of temperature and pressure, for satisfactory bonding of the plates and the pins to take place.

It is, therefore, an object of the present invention to provide improved pin-fin heat exchangers that can be accurately and consistently manufactured to the required tolerances and that have improved heat exchange capability.

Accordingly, in one aspect the invention provides a heat exchanger, the heat exchanger comprising a stack of parallel perforated plates, each plate of the stack having perforations, characterised in that the perforations define an array of spaced column precursors, of thickness equal to the plate thickness, the column precursors being joined together by ligaments, each ligament extending between a pair of adjacent column precursors, the ligaments having a thickness less than the plate thickness, the column precursors of any one plate being coincident in the stack with the column precursors of any adjacent plate whereby the stack is provided with an array of individual columns, each column extending perpendicularly to the plane of the plates, whereby fluid flowing through the stack is forced to follow a tortuous flow path to flow around the columns.

Preferably the ligaments of each plate of each pair of adjacent plates are displaced relative to those of the other plate of the pair whereby more turbulent fluid flow channels are provided through the stack, i.e. around the columns and under or over each ligament.

Thus the flow is in the general direction of the plane of the plates in that the fluid crosses the plate from one edge to an opposite edge thereof. However, additional turbulence is caused by flow under and over the ligaments.

In another aspect the invention provides a perforated plate having an array of spaced column precursors, the column precursors being of thickness equal to the plate thickness and being joined together by ligaments, each ligament extending between a pair of adjacent column precursors, the ligaments having a thickness less than the plate thickness.

The top and bottom of the stack may each be closed by a conventional solid plate, and inlet, outlet, header tank and like features may be provided as required. Side plates or bars of the stack may conveniently be formed by the stacking of unperforated border regions around the edges of individual plates of the stack, the unperforated border regions being integrally formed as part of the plate.

Preferably the perforations in the plates and the reduced thickness of the ligaments are both produced by photochemically etching, such a technique being well known in the art. However other means, e.g. spark erosion, may be used, if desired.

It is preferred that at least two different patterns of ligaments are used so that the ligaments do not completely coincide through the stack. Preferably at least two different plates are provided, i.e. the plates have different ligament patterns. Thus a tortuous flow path through the stack is provided not only around and normal to the longitudinal axes of the columns but also across the surfaces of the ligaments.

The column precursors, and hence the columns, may, in a preferred embodiment, be of circular transverse cross-section but this is not essential and any other desired cross-section may be utilised, e.g. elliptical, square, rectangular, triangular and so on, by appropriate choice of the pattern to be etched or otherwise formed in the plate.

The size, i.e. cross-sectional area, and pitch of the columns can be varied widely to suit particular circumstances and the skilled man of the art will readily be able to determine dimensions and arrays appropriate to a particular need. Similarly, the thickness and width of the ligaments, the thickness of the plates and the number of plates in the stack may be determined to achieve a required result.

A plurality of stacks of the invention may be joined together, each stack of perforated plates being separated from an adjacent stack by an unperforated, i.e. solid, plate, whereby two or more fluid streams may pass separately through the multi-stack to achieve desired heat transfer between the streams.

In an alternative embodiment a plurality of stacks of the invention may be provided in which adjacent streams are separated not by an unperforated plate but by a plate having perforations to allow controlled injection of fluid at higher pressure from one stream into fluid at lower pressure in an adjacent stream, e.g. for chemical reaction purposes.

The thickness of the ligaments may be chosen to cause more or less interruption to fluid flow as required. Thus variations in the velocity of and turbulence in the fluid flow may be achieved by appropriately designed plate patterns. Increased heat transfer (and associated pressure drop) may, therefore, be achieved by appropriate changes to the ligament dimensions. Thus thinner ligaments may be employed when it is desirable to minimise such effects.

The plates may be circular, rectangular or of any other desired shape in plan and may be formed of any suitable material, usually metal, that can be made, e.g. by etching, to the desired column and ligament patterns. The plates of a stack are preferably all of the same material and are preferably thin sheets of metal of e.g., 0.5 mm thickness or less. The material is preferably stainless steel but other metals, e.g. aluminium, copper, titanium or alloys thereof, may be used.

The components of a stack may be bonded together by diffusion bonding or by brazing or by any other suitable means. Diffusion bonding, where possible, may be preferred but, in the case of aluminium, which is difficult to diffusion bond, brazing may be necessary. It is then preferable to clad the aluminium surfaces, e.g. by hot-roll pressure bonding, with a suitable brazing alloy, in order to achieve satisfactory bonding by the brazing technique, although other means to provide the braze medium may be used, e.g. foil or vapour deposition.

The plates of the stack may be provided at their edges with extensions. In one form the extensions may be lugs to assist location of the plates in a stack. Such lugs may be designed to be broken off after the stack has been assembled, e.g. by etching partway through their thickness along a line where the lug joins the plate. Alternatively and/or additionally, the extensions may be of a form to fit together in the stack to provide, e.g. one or more tanks on the side faces of the stack. Each such extension may be, for example, in the form of a flat loop, e.g. of semi-circular profile, providing an aperture at the edge of the plate, whereby the apertures of adjacent plates form the volume of the tank when the plates are stacked together. The loops may be attached to the plates not only at their ends but also across the aperture by means of narrow cross-members to provide additional mechanical support and so give greater resistance to internal pressure. The tanks so formed can each feed a fluid into the passageways across the stack.

It is known that chemical reactions can be catalysed inside a structure such as a heat exchanger by providing a deposit of catalytic material in the internal passageways through which the fluid(s) to be catalysed are passed.

In a further embodiment of the invention is provided a heat exchanger/catalytic reactor having a plurality of passageways to contain catalytic material to promote a chemical reaction in fluid(s) to be passed through those passageways, those passageways being separated by an intervening plate from a stack of parallel perforated plates having a pin-fin structure according to the present invention. Thus the stack of plates separated by the intervening plate from the adjacent passageways, which later will be filled with catalytic material, is formed from perforated plates, each having an array of spaced column precursors, the column precursors being of thickness equal to the plate thickness and being joined together by ligaments extending between pairs of adjacent column precursors, the ligaments having a thickness less than the plate thickness. Once the heat exchanger structure has been completed and tested, the catalytic material may be packed into its passageways. However, the packing of the catalytic material will normally be completed immediately prior to the installation of the heat exchanger/reactor into its desired use position.

The passageways to contain the catalytic material are preferably defined between parallel ribs running the length of their plates to allow convenient introduction of the catalytic material and its subsequent removal at the end of its life cycle. The passageways may be closed off at one or both ends by a mesh to retain the catalytic material.

By means of this further embodiment, heating or cooling can very effectively be provided for the chemical reaction by passing a heating or cooling fluid through the stack of plates adjacent to the layers containing the catalyst. As indicated above, this structure causes such tortuous flow and turbulence that very good heat transfer properties can be achieved, especially with gaseous fluids. The catalysed reaction may, therefore, if exothermic, be effectively cooled by passage of a suitable cooling fluid, or if endothermic, may be heated and hence initiated or improved by passage of a suitable heating fluid, through the pin-fin stack.

This further embodiment may also be used in conjunction with the above-described injection construction, i.e. the heat exchanger may have a first stack containing the passageways containing catalytic material, an adjacent second stack separated from the first stack by an intervening plate with injection holes and a third stack of the pin-fin cooling or heating construction. The first stack may, for example, lie between the second and third stacks, or they may lie in the order—first, second, third. Needless to say, these three stacks maybe repeated a number of times to form the complete heat exchanger/reactor.

Embodiments of the invention will now be described by way of example only with reference to the accompanying drawings in which.

Figure 1:
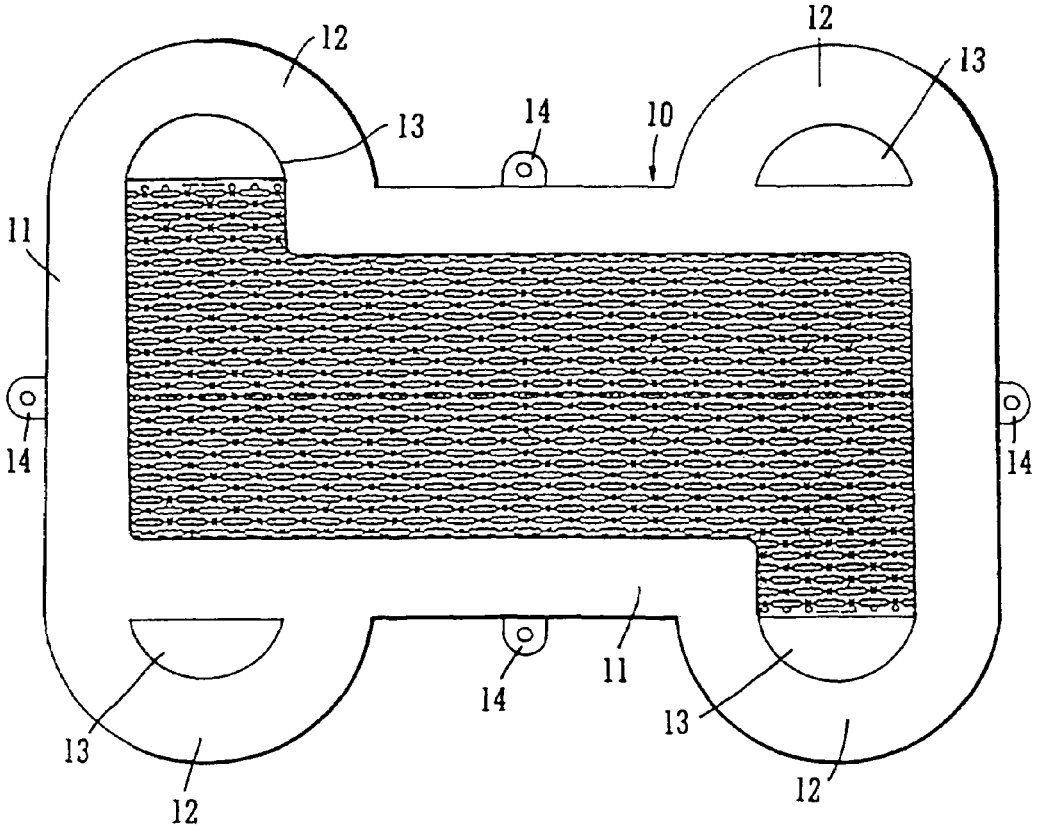
FIG. 1 is a plan view of one perforated plate of the invention.
Figure 2:
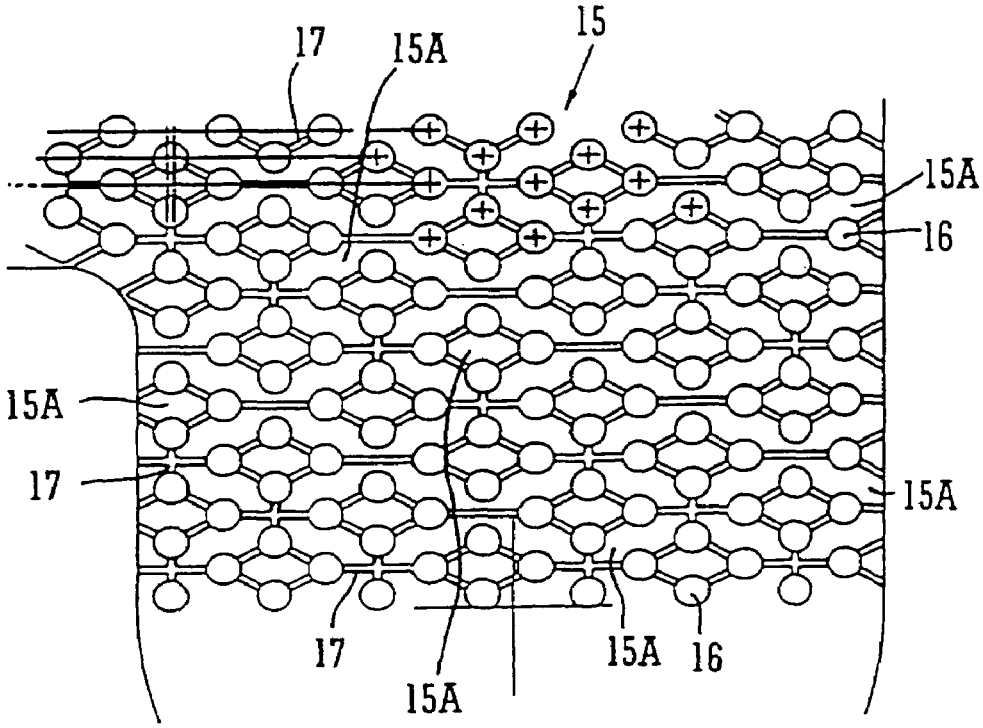
FIG. 2 is an enlarged view of a portion of the central region of the plate of FIG. 1.
Figure 3:
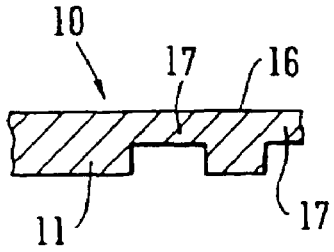
FIG. 3 is a section through the thickness of the perforated plate of FIG. 1 at an edge region thereof.

In FIGS. 1, 2 and 3 is shown a thin perforated metal plate 10 of generally rectangular shape and having an unperforated border region 11 around its perimeter. Four integral loops 12, one adjacent each corner of the plate, define apertures 13 which, when a stack of similar plates is assembled, form tanks through which inlets and outlets to and from the stack can be positioned.

A positioning lug 14 is integrally formed centrally of each of the four edges of the plate to assist assembly into a stack of plates.

The central region 15 of the plate inside border 11 has been etched to provide a plurality of apertures 15A (FIG. 2) defining an array of column precursors and ligaments, the ligaments joining adjacent column precursors together and to the border region 11. A portion of central region 15 is shown in greater detail in FIG. 2.

In FIGS. 2 and 3 an array of column precursors 16 and ligaments 17 is shown. The column precursors are circular in cross-section and of height equal to the thickness of the plate. In this array they are arranged in lozenge shaped groups of four and each group is joined to three or four adjacent groups by ligaments from its column precursors to the precursors of other groups.

The ligaments 17 have been etched to half the thickness of the plate.

Figure 4:
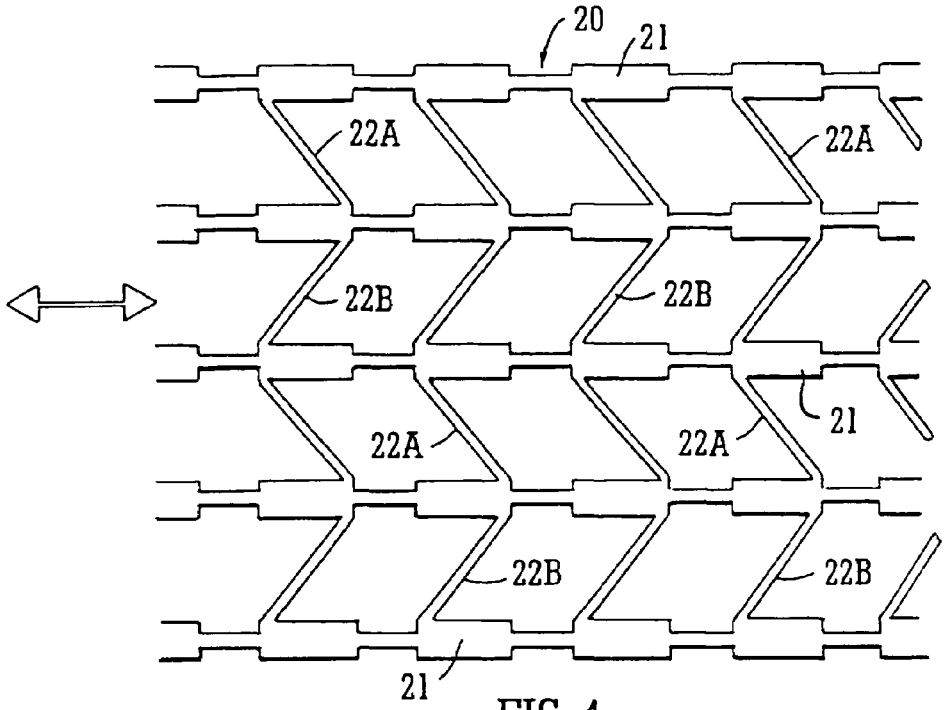
FIG. 4 is a diagrammatic illustration in plan view in enlarged scale of a central portion of a second perforated plate of the invention.

In FIG. 4 the central region of plate 20 has an array of rectangular section column precursors 21 in rows, each column precursor in one row being attached to an adjacent precursor in the next row or rows by a diagonally-extending, relatively thin, i.e. in plan, ligament 22A or 22B. Ligaments 22A between a first pair of rows of column precursors are angled in the opposite direction to ligaments 22B between the next row and this is repeated across the plate.

Figure 5:
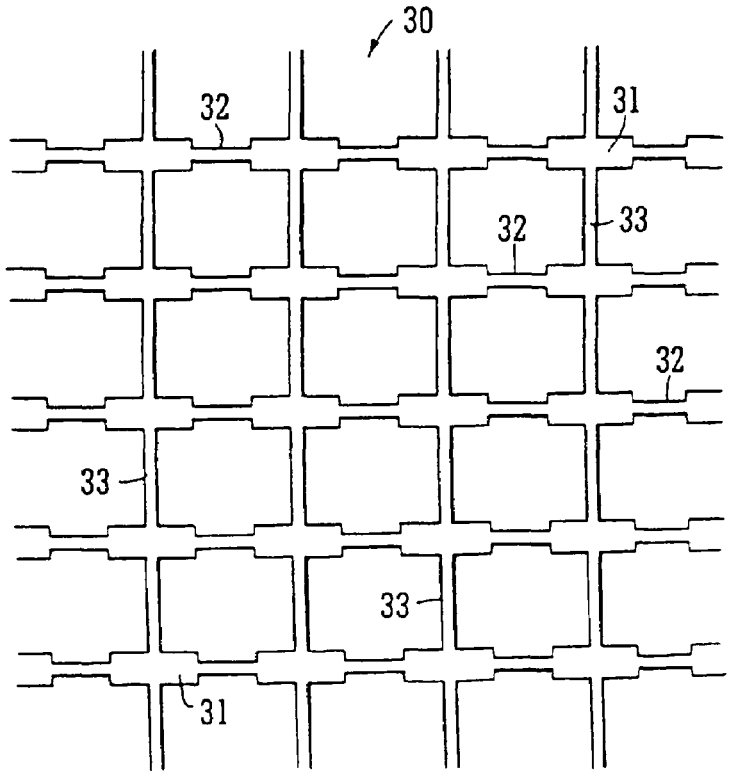
FIG. 5 is a similar illustration to FIG. 4 of a third perforated plate of the invention.

In FIG. 5, the central region of plate 30 has the same linear array of column precursors 31 as FIG. 4. Column precursors 31 have the same dimensions as column precursors 21 of plate 20 and are spaced at the same positions in the plate. Plates 20 and 30 are of identical size.

Column precursors 31 are joined to the adjacent precursors in the same row by ligaments 32 and to adjacent precursors in the next row or rows by ligaments 33.

Figure 6:
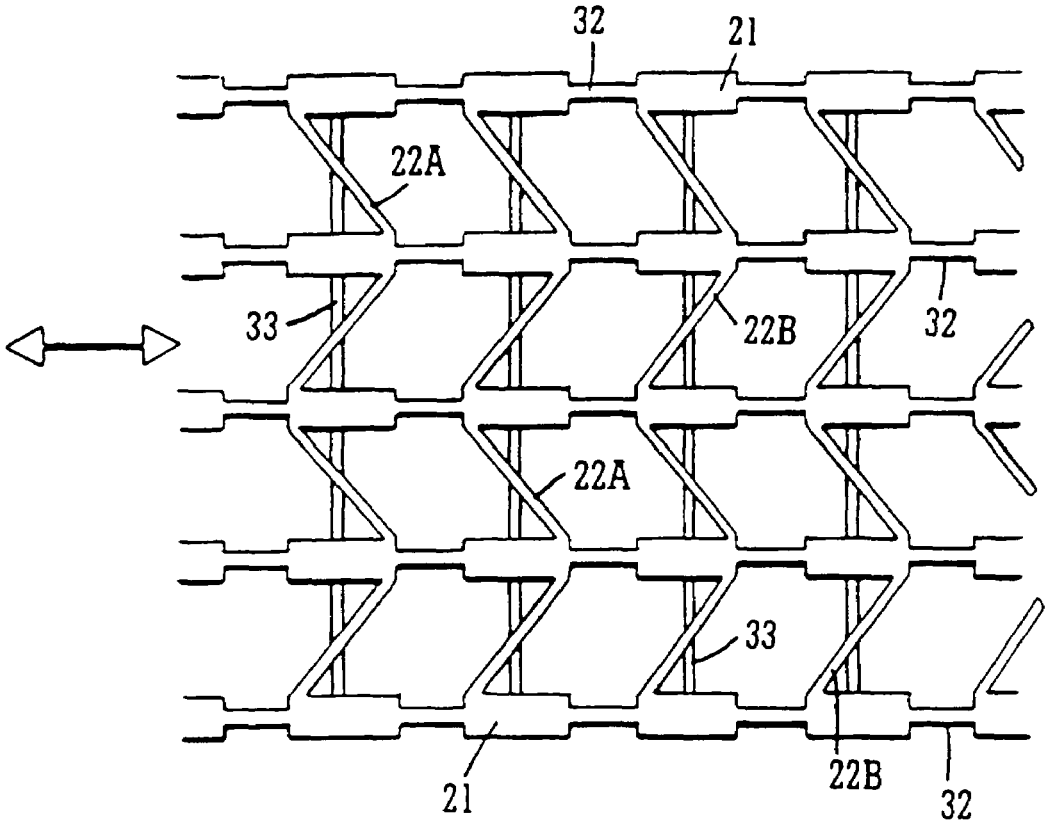
FIG. 6 is a similar view of the plates of FIGS. 4 and 5 stacked together.

When plates 20 and 30 are stacked together with their column precursors aligned, the effect is shown in FIG. 6, where plate 20 is shown above plate 30. Hence only column precursors 21 are visible.

The double headed arrow indicates possible flow directions when the plates are stacked to form a heat exchanger.

As can be appreciated when a plurality of pairs of plates 20 and 30 are stacked together, the ligaments 22A, 22B, 32 and 33 provide a tortuous path in addition to the need for the fluid to pass around the columns that are formed from the stacked column precursors. Thus excellent heat transfer properties can be achieved.

Figure 7:
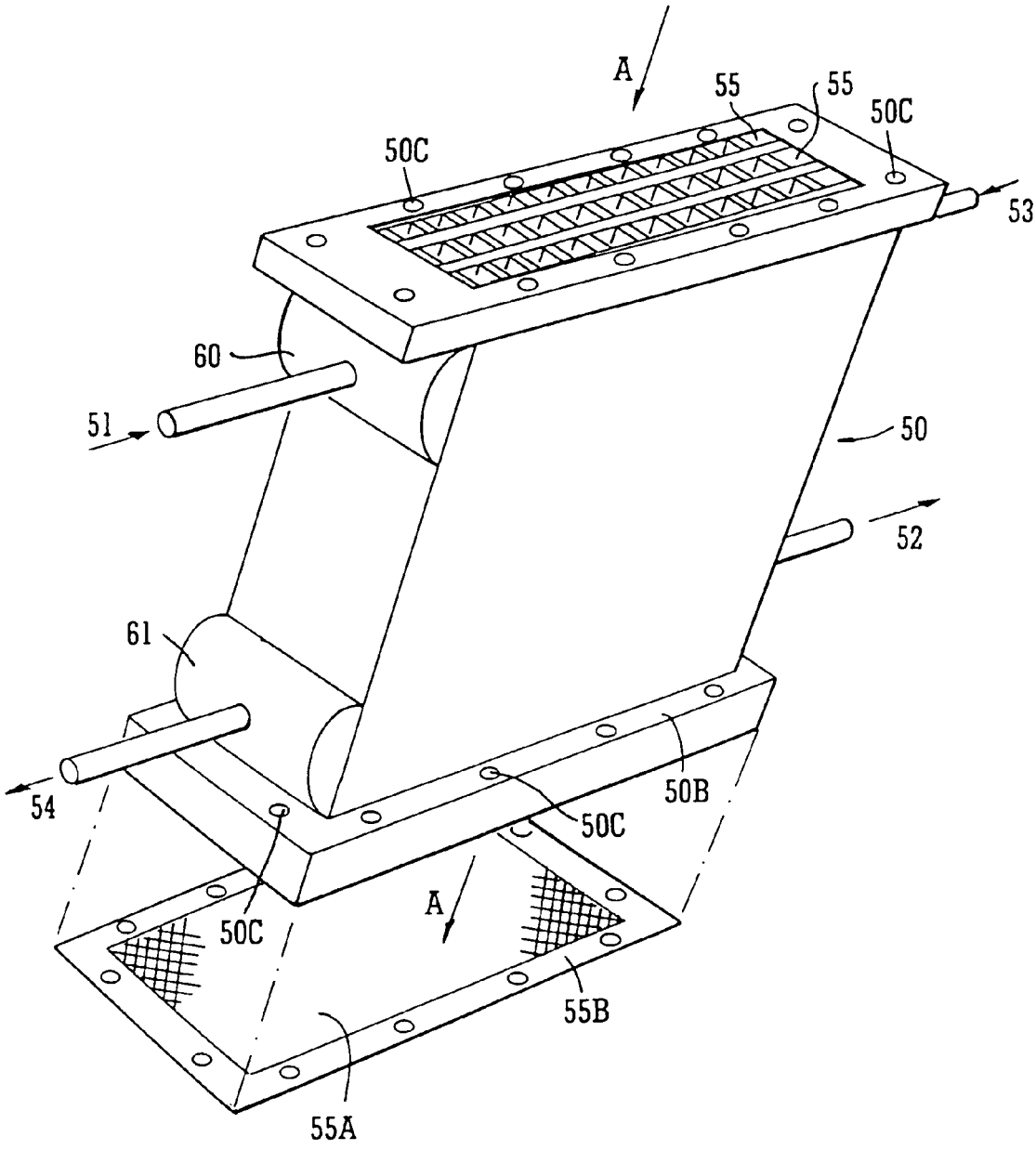
FIG. 7 is a perspective view, partly exploded, of a heat exchanger of the invention suitable for use as a catalytic reactor.

In FIG. 7 a heat exchanger/catalytic reactor 50 has an inlet 51 and an outlet 52 for coolant (or if required a heating fluid to initiate an endothermic reaction) and an inlet 53 and an outlet 54 for a reactant fluid which is to be injected as described in greater detail below into a process fluid which passes through the open-through passageways 55 through reactor 50 in the direction of arrow A. The inlets and outlets lead into and out of tanks 60 and 61 respectively from which the fluids are fed into their appropriate stacks.

Reactor 50 will of course be connected in a fluid-tight manner to a pipeline (not shown) or other means of passing the process stream from a source, through the reactor 50 to a suitable receiving vessel by conventional means. Such connection may conveniently be made by bolting flanges 50A and 50B at either end of reactor 50 to corresponding flanges provided in the pipeline or other means using bolt holes 50C.

The passageways or channels 55 are defined in stacks of plates to be described with reference to FIGS. 9 and 10 below. These channels may be packed with catalyst and, after a period of use, the reactor 50 may be readily unbolted from its pipeline, the spent catalyst removed from channels 55 and fresh catalyst inserted so that the reactor is ready for re-use.

A mesh 55A mounted in a frame 55B can be clamped to flange 50B and/or 50A to retain the catalyst in the passageways 55.

Figure 8:
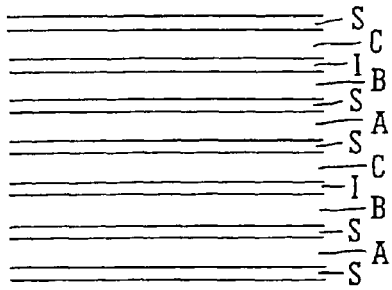
FIG. 8 is a diagrammatic representation of the plate arrangement inside the heat exchanger of FIG. 7.

The order or arrangement of plates in the reactor 50 is as shown in FIG. 8.

At each end of the total stack of plates is a solid unperforated plate S, which is described with reference to FIG. 13 below.

Above bottom plate S in FIG. 8 is a stack A of plates defining passageways to receive the coolant (or heating) stream through inlet 51. The plates of stack A are described with reference to FIG. 12 below.

Above stack A is another separator plate S. Above that plate S is stack B of plates defining passageways to receive a reactant fluid. The plates of stack B are as described with reference to FIG. 11 below.

Above stack B is an injection plate I which is described with reference to FIG. 14 below.

Above injection plate I is a stack C of plates defining the passageways 55 referred to above for the process fluid. The plates of stack C are described with reference to FIGS. 9 and 10 below.

Above stack C is another separator plate S.

This structure is then repeated with another stack A and so on as many times as is required to build up heat exchanger/reactor 50 to the desired capacity.

Figure 13:
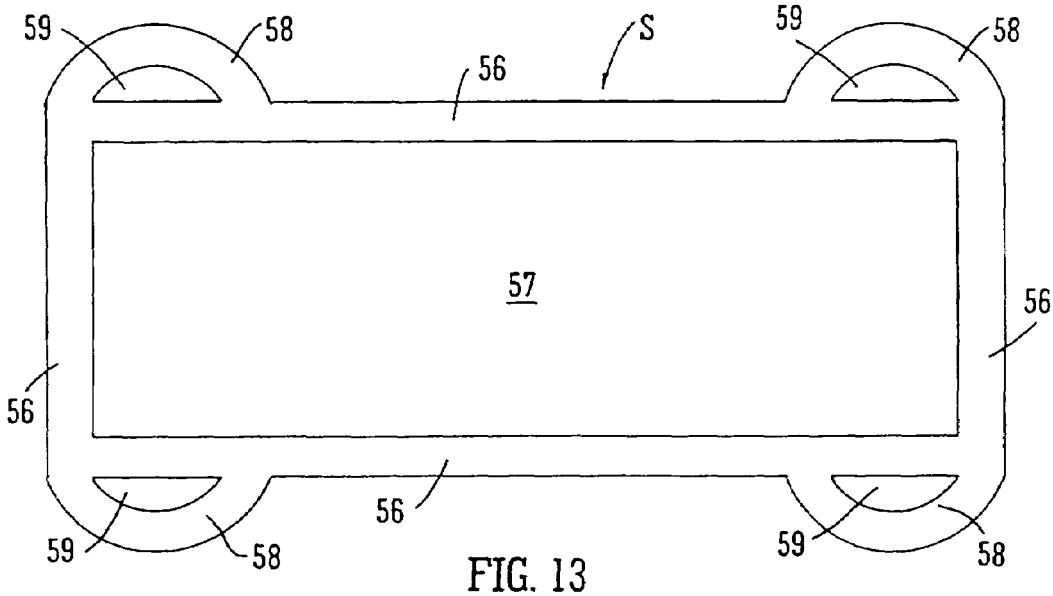
FIG. 13 is a plan view of a separator or intervening plate to lie between the stacks of FIGS. 11 and 12.

A separator plate S is shown in FIG. 13. It has a rectangular plan form having a border region 56 which can be bonded to the corresponding border regions of adjacent plates by one of the means discussed above. Border region 56 encloses an unperforated, i.e. solid, central region 57 which prevents fluid flow passing from one side of plate S to its other side. Adjacent each corner of the plate S is a loop extension 58 defining an enclosed region or aperture 59. These loops 58 stack together with corresponding portions of the other plates stacked in the heat exchanger to form two inlet and two outlet tanks 60 and 61 respectively, one of each being visible in FIG. 7.

Figure 12:
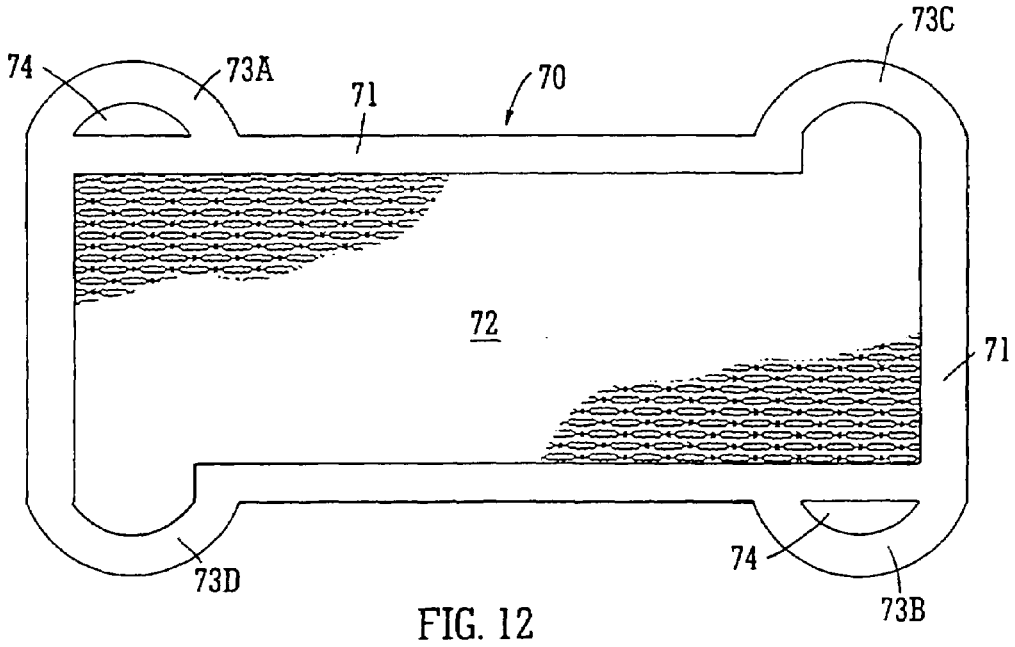
FIG. 12 is a plan view of another stack of plates similar to the plates of FIG. 11, which stack is used in the heat exchanger of FIG. 7 to provide a cooling or heating fluid as required.

The top plate of stack A is shown in FIG. 12. Two or more such plates 70 are required and each is of a rectangular form having a border region 71 for bonding to adjacent plates and a central region 72. Region 72 is of pin-fin construction—not shown here but, for example, as shown in FIGS. 1 to 3. As with plate S, adjacent the corners of plate 70 are loops, two of which, 73A and 73B, in opposite corners, enclose an aperture 74 and the other two of which 73C, 73D, open into central region 72, thereby providing entry and exit for coolant fluid passing across and through stack A via inlet 51 and outlet 52 shown in FIG. 7.

Figure 11:
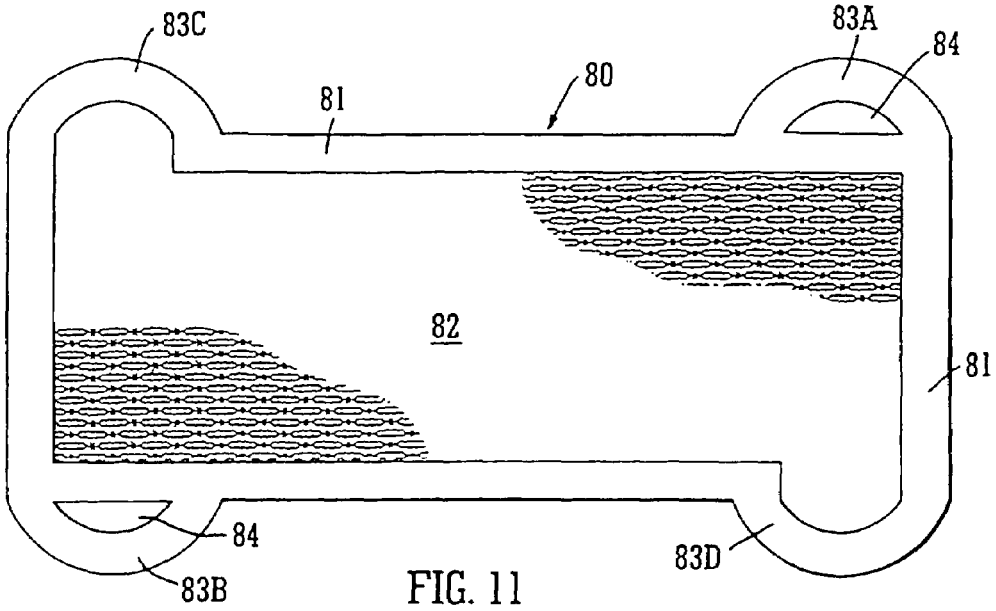
FIG. 11 is a plan view of a stack of a second type of plate used in the heat exchanger of FIG. 7 to provide a reactant fluid to be injected into the process fluid.

The top plate of stack B is shown in FIG. 11. Two or more such plates 80 are required and they are of identical structure to plates 70. Thus they have a border region 81 enclosing a central pin-fin region 82. They have enclosed loops 83A and 83B and loops 83C and 83D, the latter two loops providing an inlet and an outlet for reactant fluid to pass across and through stack B via inlet 53 and outlet 54 of FIG. 7.

Figure 14:
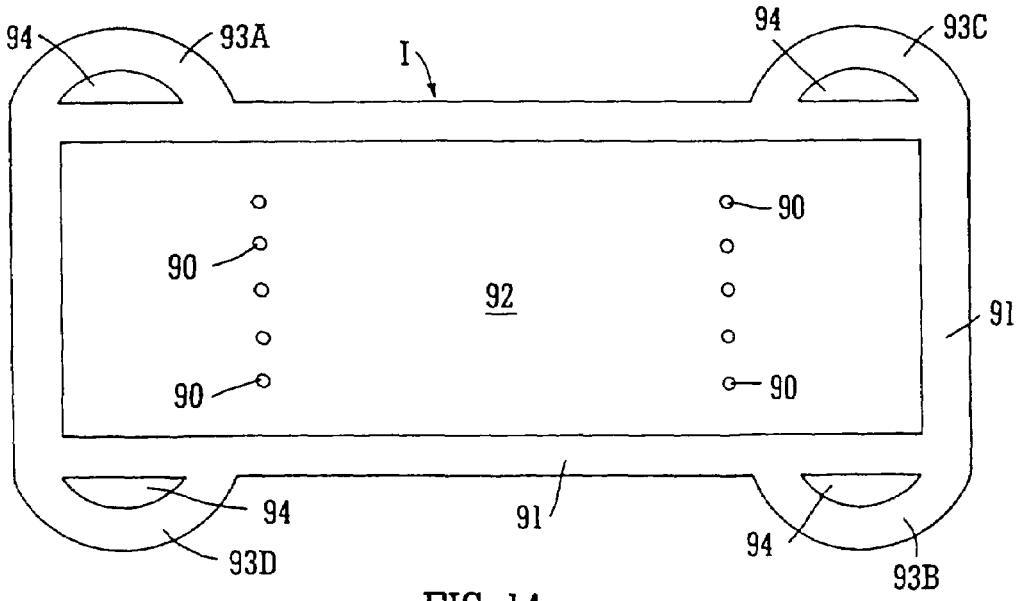
FIG. 14 is a plan view of an injection plate to lie between the stacks of FIGS. 9 and 11.

Injector plate I is shown in FIG. 14. It is of the same rectangular form as the plates described above, having a border region 91 enclosing a central region 92. Region 92 is not imperforate but has a series of injection holes 90 passing through its thickness. Thus reactant fluid passing through stack B on one side of plate I can be arranged to be at higher pressure than process fluid passing through stack C on the other side of plate I, whereby the reactant fluid will be injected through holes 90 into the process fluid to cause the desired chemical reaction. Holes 90 can be of size and distribution to suit the required amount of reactant fluid to be injected.

As with the previously described plates, plate I has corner loops 93A, B, C, D, and each loop encloses an aperture 94 to form part of the tanks 60 and 61 shown in FIG. 7.

Figure 10:
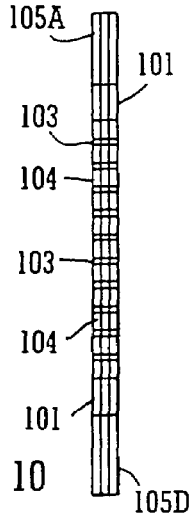
FIG. 10 is a section on line X—X of FIG. 9.
Figure 9:
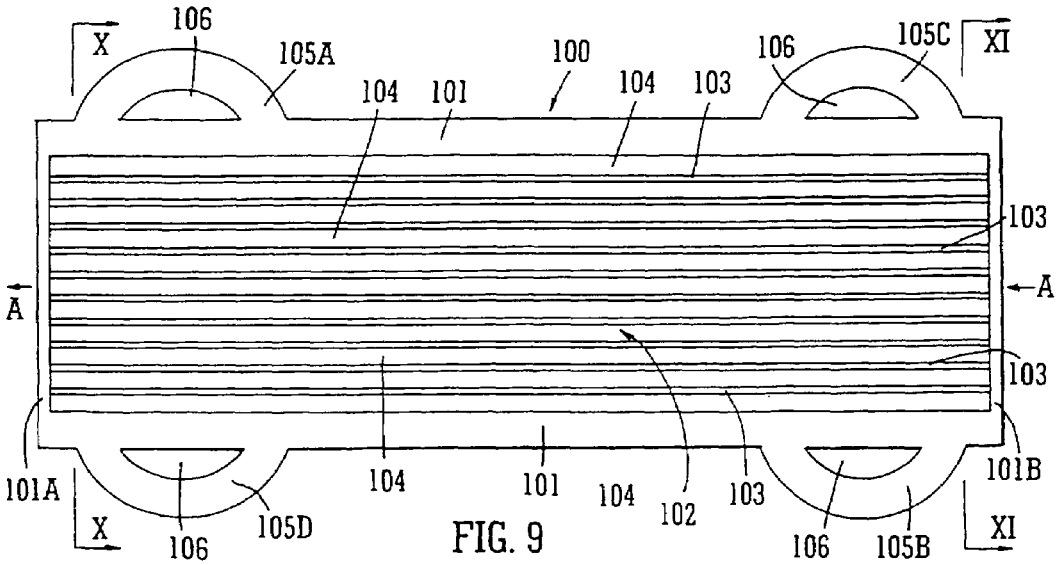
FIG. 9 is a plan view of a stack of three first type of plates used in the heat exchanger of FIG. 7 to provide the passageways for a process fluid to undergo chemical reaction.

The plates 100 of stack C are shown in FIGS. 9 and 10. Three plates are shown in this stack although it will be appreciated that more or less plates may be used, as desired. Again, plates 100 are rectangular with a border region 101 along their two longer edges. Border regions 101A, 101B along their shorter edges are designed to be removed by cutting along lines X—X and XI—XI after the plates have been bonded to the other plates in the heat exchanger.

Central region 102 of each plate 100 has a series of parallel ribs 103 running along its longer length. Between adjacent pairs of ribs 103 and between each outermost rib 103 and border region 101 lie open channels 104, (equivalent to channels 55 in FIG. 7). The channels extend completely through the thickness of the plate. When ends 101A and 101B are removed process fluid can pass from one side of stack C, where ends 101B were, along channels 104 and out at the other end, i.e. where ends 101A were, as indicated by arrows A. Arrows A here correspond to arrow A in FIG. 7.

It will be appreciated that ribs 103 are held in their positions initially by being joined to ends 101A and 101B of plate 100. When the plates of the stacks are bonded together, ribs 103 bond to a plate I below or plate S above (as in the arrangement shown in FIG. 8) or to the corresponding ribs of adjacent plates 100. Thus when ends 101A and 101B are removed, the ribs remain firmly in place.

Channels 104 may be packed with catalyst to promote the reaction between the process fluid passing across and through stack A with the injected reactant fluid for stack B.

Plates 102 each have corner loops 105A, B, C, D, completely enclosing apertures 106, to form part of the tanks 60 and 61.

By way of example only, plates 100 may be about 2 mm in thickness and the requisite number of such plates will be stacked together to give the desired channel height.

Figure 15:
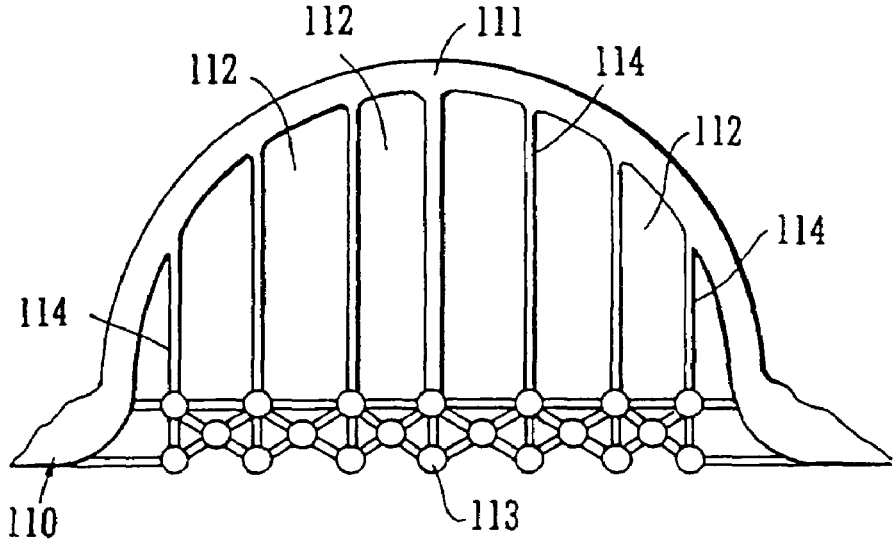
FIG. 15 is a plan view of a portion of another plate for use in the invention.

In FIG. 15 is shown a loop extension portion of a plate 110.

The loop extension 111 defines a region of apertures 112, which opens into central region 113 of the plate, which is of the pin-fin construction described above. Thus this loop extension forms part of an inlet or outlet for the pin fin passageways.

Loop extension 111 is reinforced by cross-members 114, each extending from the inner perimeter of the loop to connect with a portion of the pin-fin structure 113.

Figure 16:
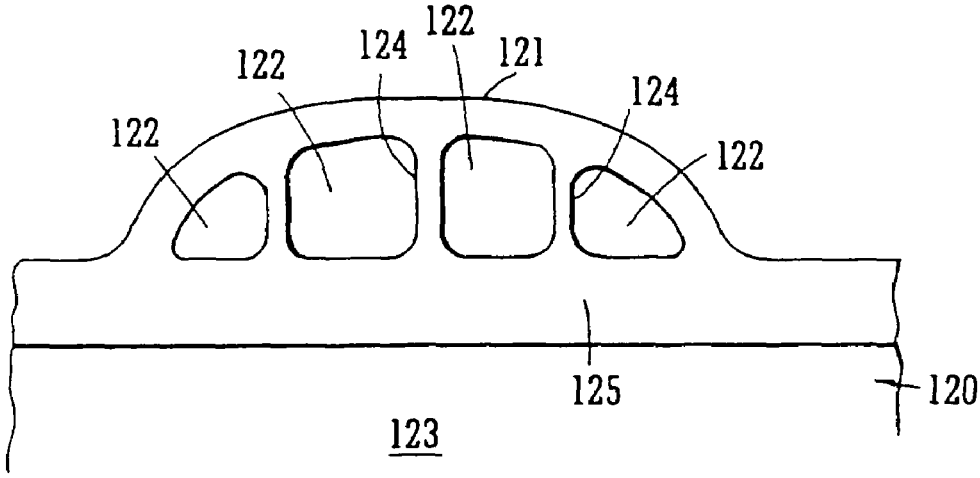
FIG. 16 is a similar view to FIG. 15 of a portion of a different plate for use in the invention.

In FIG. 16 is shown another loop extension, of different shape, of a plate 120. The loop extension 121 defines apertures 122 which are closed off from the central pin-fin region 123 of the plate. Again the loop is strengthened by cross-members 124 which define the apertures 122 between the loop 121 and unperforated border region 125, which separates the apertures from the fin-fin region of the plate.

When two or more plates 110 or 120 are stacked together, it will be desirable to offset the cross-members 114 or 124 respectively from those of adjacent plates so as to provide a tortuous route through the tanks formed by the stacked loops.

What is claimed is:

1. A heat exchanger or reactor comprising a stack of parallel plates, wherein each plate of the stack having perforations defining an array of spaced column precursors of thickness equal to the plate thickness, said column precursors being joined together by ligaments having a thickness less than the plate thickness, each ligament extending between a pair of adjacent column precursors such that the column precursors of any one plate being coincident in the stack with the column precursors of any adjacent plate, whereby the stack is provided with an array of individual columns, each column extending perpendicularly to the plane of the plates whereby fluid flowing through the stack is forced to follow a tortuous flow path around the columns, and has the ability to flow parallel to the plane of each said plate.

2. A heat exchanger or reactor according to claim 1, wherein the headers are provided within the profile of the plate.

3. A heat exchanger or reactor according to claim 1, wherein there comprises an arrangement of interlinking ligaments between adjacent column precursors.

4. A heat exchanger or reactor according to claim 1, wherein there comprises a plurality of ligaments connected to each said precursor.

5. A heat exchanger or reactor according to claim 1, wherein each plate is provided within the profile of the plate with apertures which stack together to provide one or more header tanks.

6. A heat exchanger or reactor according to claim 1, wherein each said ligament extending between a pair of adjacent column precursors is displaced relatively adjacent to ligaments positioned above and/or below said ligament.

7. A heat exchanger or reactor according to claim 1, wherein the top and bottom of the stack are closed by unperforated plates.

8. A heat exchanger or reactor according to claim 1, wherein the stack has side plates which are formed by the stacking of unperforated border regions around the edges of individual plates of the stack, the unperforated border regions being integrally formed as part of the plate.

9. A heat exchanger or reactor according to claim 1, wherein the perforations in the plates and the reduced thickness of the ligaments are produced by photochemical etching or spark erosion.

10. A heat exchanger or reactor according to claim 1, wherein at least two differently perforated plates are used, the two plates having different ligament patterns.

11. A heat exchanger or reactor according to claim 1, wherein the column precursors are of circular cross section.

12. A heat exchanger or reactor according to claim 1, wherein the perforated plates are of metal of thickness 0.5 mm or less.

13. A heat exchanger or reactor according to claim 1, wherein the components of the stack are diffusion bonded together.

14. A heat exchanger or reactor according to claim 1, wherein the components of the stack are brazed together.

15. A heat exchanger or reactor according to claim 14, wherein the plates of the stack are provided at their edges with extensions to assist location of the plates in the stack.

16. A heat exchanger or reactor according to claim 1, wherein each plate is provided with extensions in the form of loops which stack together to provide one or more tanks at the sides of the stack.

17. A heat exchanger or reactor according to claim 16, wherein the loops are reinforced by cross-members.

18. A heat exchanger or reactor according to claim 1, further comprising a plurality of stacks of plates and one pair of adjacent stacks are separated by a plate having perforations to allow controlled injection of fluid at higher pressure from one stack into fluid at lower pressure in an adjacent stack.

19. A heat exchanger or reactor according to claim 1, further comprising a plurality of passageways to contain catalytic material, said passageways being separated by an intervening plate from the stack of parallel perforated plates.

20. A heat exchanger or reactor according to claim 19, wherein the passageways to contain the catalytic material are defined between plates having parallel ribs running the length of the plates.

21. A heat exchanger or reactor according to claim 19, wherein the passageways to contain the catalytic material are closed at one or both of their ends by mesh material.

22. A heat exchanger or reactor according to claim 1, further comprising a plurality of joined stacks of the parallel perforated plates, each stack being separated from an adjacent stack by a solid unperforated plate whereby two or more separate fluid stream passageways are provided.

* * * * *